US011486165B2

(12) United States Patent
Tsai

(10) Patent No.: US 11,486,165 B2
(45) Date of Patent: Nov. 1, 2022

(54) DOOR LOCK CONFIGURED TO BE OPENED BY ONE HAND

(71) Applicant: Miao-Hsueh Tsai, Taichung (TW)

(72) Inventor: Miao-Hsueh Tsai, Taichung (TW)

( * ) Notice: Subject to any disclaimer, the term of this patent is extended or adjusted under 35 U.S.C. 154(b) by 280 days.

(21) Appl. No.: 16/802,953

(22) Filed: Feb. 27, 2020

(65) Prior Publication Data

US 2021/0270059 A1 Sep. 2, 2021

(51) Int. Cl.

| | |
|---|---|
| ***E05B 65/00*** | (2006.01) |
| ***E05B 9/02*** | (2006.01) |
| ***E05B 63/00*** | (2006.01) |
| ***E05B 15/04*** | (2006.01) |
| ***E05B 9/08*** | (2006.01) |
| ***E05B 9/04*** | (2006.01) |
| ***E05B 9/00*** | (2006.01) |

(52) U.S. Cl.

CPC ..... *E05B 65/0025* (2013.01); *E05B 9/002* (2013.01); *E05B 9/02* (2013.01); *E05B 9/04* (2013.01); *E05B 9/08* (2013.01); *E05B 15/04* (2013.01); *E05B 63/006* (2013.01); *E05B 63/0056* (2013.01); *E05B 2009/046* (2013.01); *E05Y 2900/132* (2013.01)

(58) Field of Classification Search

CPC ..... E05B 65/0025; E05B 9/00; E05B 9/002; E05B 9/02; E05B 9/08; E05B 9/084; E05B 9/04; E05B 15/10; E05B 15/102; E05B 15/104; E05B 17/20; E05B 17/2007; E05B 17/2015; E05B 17/203; E05B 17/2034; E05B 55/00; E05B 55/12; E05B 63/006; E05B 17/2019; Y10T 292/096; Y10T 292/0969; Y10T 292/097; Y10T 292/0971; Y10T 292/0976; Y10T 292/0977; Y10T 292/098; Y10T 292/0982; Y10T 292/0985; Y10T 292/1016; Y10T 292/102; Y10T 292/1015; Y10T 292/1014

See application file for complete search history.

(56) References Cited

U.S. PATENT DOCUMENTS

2008/0072635 A1* 3/2008 Chang ..... E05B 55/06 70/210
2014/0265362 A1* 9/2014 Chang ..... E05C 19/163 292/175
2016/0153213 A1* 6/2016 Huang ..... E05B 55/12 292/144

FOREIGN PATENT DOCUMENTS

DE 19839043 A1 * 3/2000 ..... E05B 55/06
DE 202014009557 U1 * 2/2015 ..... E05B 63/0017

* cited by examiner

*Primary Examiner* — Christine M Mills
*Assistant Examiner* — Peter H Watson
(74) *Attorney, Agent, or Firm* — Alan D. Kamrath; Karin L. Williams; Mayer & Williams PC

(57) ABSTRACT

A door lock includes a lock with a latch. An inside face plate and an outside face plate of the door lock are respectively mounted to an inside plate and an outside plate of the door lock. A washer plate is sandwiched between the inside face plate and the outside face plate. An inside cylinder and an outside cylinder are connected between the inside plate and the outside plate. An inside collar is connected between the inside face plate and the inside cylinder, and an outside collar is connected between the outside face plate and the outside cylinder. When the door lock is set in ready-to-open mold, the door can be opened by either rotating the shafts or the door handle by one hand. When the door lock is set in locked mold, the door cannot be opened by simply rotating the door handle.

6 Claims, 10 Drawing Sheets

DOOR LOCK CONFIGURED TO BE OPENED BY ONE HAND

BACKGROUND OF THE INVENTION

1. Fields of the Invention

The present invention relates to a door lock, and more particularly, to a door lock for glass doors and the glass door can be opened by one hand.

2. Descriptions of Related Art

The conventional glass door has a door lock which is located above a door handle. The door lock includes a latch unit which has a latch. The door frame includes room with a strike plate mounted to the door frame, when the latch is inserted into the room via the strike plate, the door is closed. When opening the glass door, the user has to unlock the door lock to remove the latch from the door frame, and uses then other hand to rotate the door handle. In other words, the user has to use both of his/her hands to open the glass door. Generally, the user will set the latch at a retracted position, so that the glass door can be easily opened, and children may easily open the glass door without permission.

The present invention intends to provide a door lock which is locked and can be unlocked by using one hand.

SUMMARY OF THE INVENTION

The present invention relates to a door lock and comprises a lock having a base, a cover, a latch unit, an expansion spring, a link, a compression spring, a first drive member, a second drive member and a torsion spring. The base has a bottom plate with two lateral plates. One front plate and one rear plate respectively extend from the four sides of the bottom plate. The bottom plate includes a first bore and a second bore defined therethrough. Multiple rods extend from the top face of the bottom plate. Each rod has a threaded hole defined in the distal end thereof. Two first slots are respectively defined in the two sides of the bottom plate.

The cover includes a plurality of through holes through which the rods extend. The cover has a third bore and a fourth bore respectively defined therethrough, wherein the third bore is located corresponding to the first bore, and the fourth bore is located corresponding to the second bore. The cover further includes two second slots respectively in two sides thereof. The two second slots are located corresponding to the first slots. The cover is connected to the base to form a room therebetween. The latch unit, the link, the first drive member, the second drive member, the expansion spring, the compression spring and the torsion spring are accommodated within the room.

The latch unit includes a latch and an extension portion that is connected to the latch. The extension portion includes a positioning portion to which one end of the expansion spring is hooked. A recess is defined in the distal end of the extension portion and a notch is defined in one of two insides of the recess. A push ramp is formed adjacent to the notch. The extension portion includes a restriction slot with which a protrusion extending from the link is engaged. The expansion portion includes a lug which is located in the restriction slot and separates the restriction slot into two recessed areas which communicate with each other. When the latch unit moves, the protrusion moves from one recesses area to another one of the two recessed areas by guidance of the lug.

The link includes a pivotal hole through which one of the rods extends. The protrusion extends from the link and is engaged with one of either the first slot or the second slot and the restriction slot. The link includes a guide portion to which the first drive member pushes.

The first drive member includes a restriction hole and a top portion. The top portion pushes the guide portion to move the link. A bolt extends through the restriction hole of the first drive member and is connected to the first and second cylinders so that first drive member is co-rotated with the first and second cylinders.

The second drive member includes a tube which extends through the second bore and the fourth bore. Two push portions are formed on a first end of the second drive member so as to push the latch unit. A key part is formed on a second end of the second drive member so as to shift the torsion spring. The tube includes a rectangular hole, and a door handle is connected to the rectangular hole so that the second drive member is co-rotated with the door handle.

The expansion spring is hooked between the rod of the base and the positioning portion of the latch unit. The compression spring is biased between the restriction portion of the link and the lateral plate. The torsion spring is mounted to the tube and has two legs which are crossly located two sides of the key part of the second drive member and two sides of the rear plate.

An inside plate includes a first threaded hole located corresponding to the third bore, a first hole located corresponding to the fourth bore, and a second hole located corresponding to the through hole. The inside plate further has a threaded aperture through which a screw threadedly extends, a first adjustment threaded hole communicating with the first threaded hole, and a first restriction hole in which a first biasing spring and a first end piece are received therein.

An outside plate includes a second threaded hole located corresponding to the first bore, a third hole located corresponding to the second bore, a plurality of fourth holes located corresponding to the plurality of threaded holes, a through bore located corresponding to the threaded aperture of the inside plate, a second adjustment threaded hole communicating with the second threaded hole, and a second restriction hole in which a second biasing spring and a second end piece are received therein.

An inside face plate includes a first aperture located corresponding to the first threaded hole, a second aperture located corresponding to the first hole, a first cutout located corresponding to the first adjustment threaded hole, and a first positioning hole with which the first end piece is engaged.

An outside face plate includes a third aperture located corresponding to the second threaded hole, a fourth aperture located corresponding to the third hole, a second cutout located corresponding to the second adjustment threaded hole, and a second positioning hole with which the second end piece is engaged.

A washer plate is clamped between the inside outside plate and the outside face plate.

An inside lock set includes a first threaded body threadedly connected to the first threaded hole of the inside plate. Multiple first axial grooves are defined in the first threaded body. A first lip extends outward from the top of the first threaded body, and a first cylinder is located in the first threaded body so as to rotate the first threaded body.

An outside lock set includes a second threaded body threadedly connected to the second threaded hole of the outside plate. Multiple second axial grooves are defined in the second threaded body. A second lip extends outward from the top of the second threaded body, and a second cylinder is located in the second threaded body so as to rotate the second threaded body.

An inside collar is clamped between the inside face plate and the inside lock set. An outside collar is clamped between the outside face plate and the outside lock set.

The first and second axial grooves are located in front of the first and second adjustment threaded holes so that two countersunk head bolts respectively contact against an inside of the first and second axial grooves. The first drive member controls movement of the latch unit to adjust the latch to be retracted and separated from door frame.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
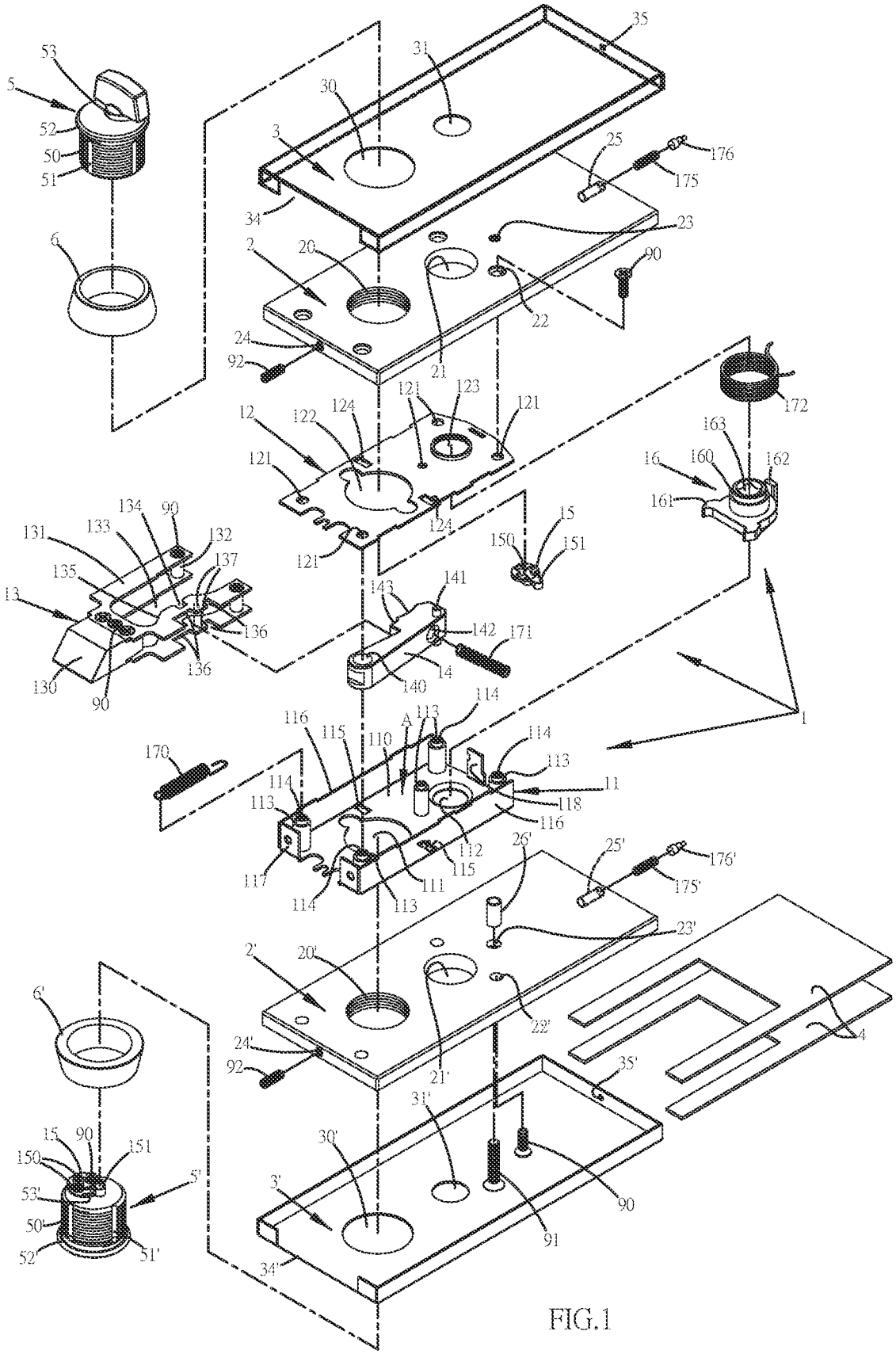
FIG. 1 is an exploded view of the door lock of the present invention.
Figure 2:
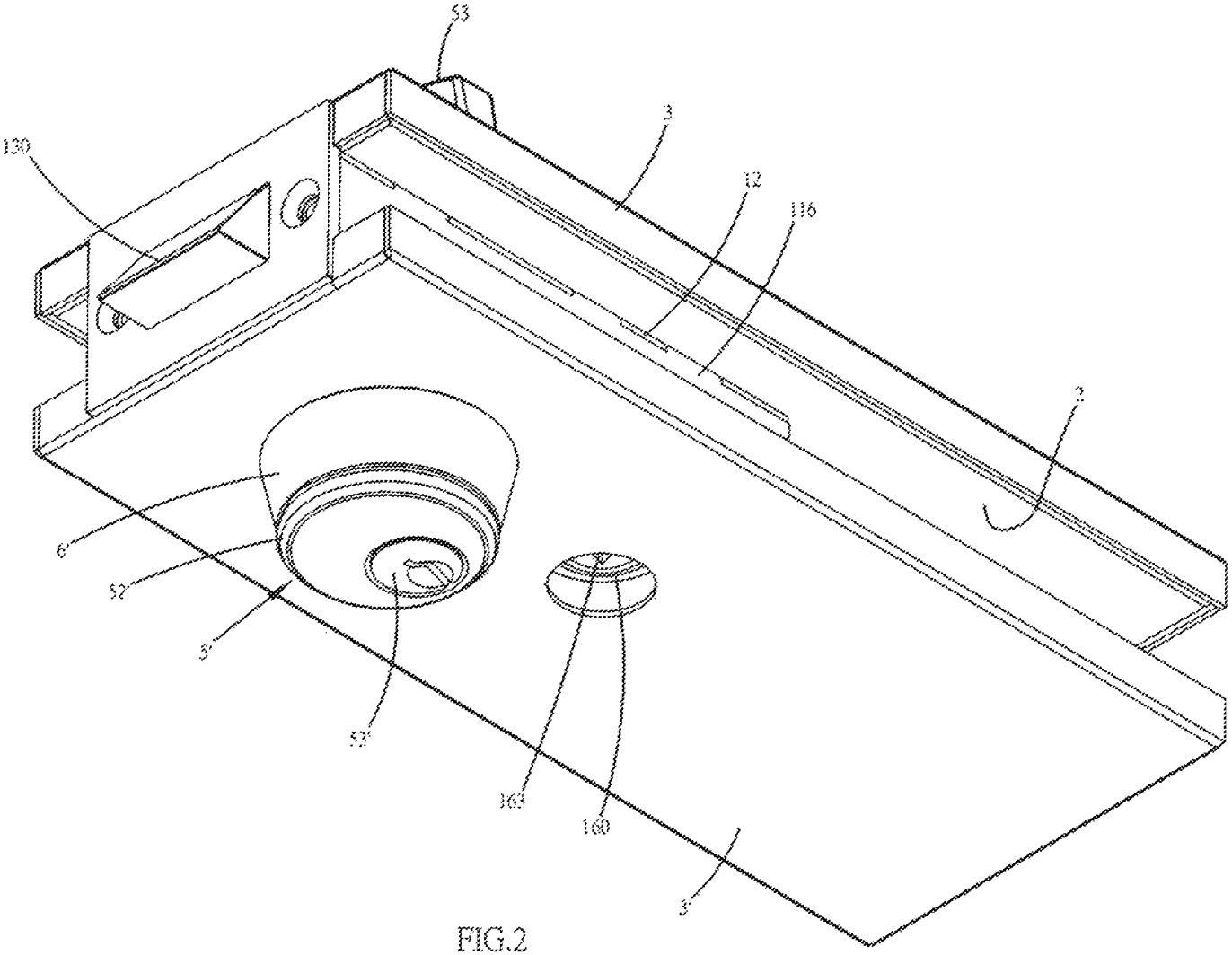
FIG. 2 is a perspective view to show the door lock of the present invention.
Figure 3:
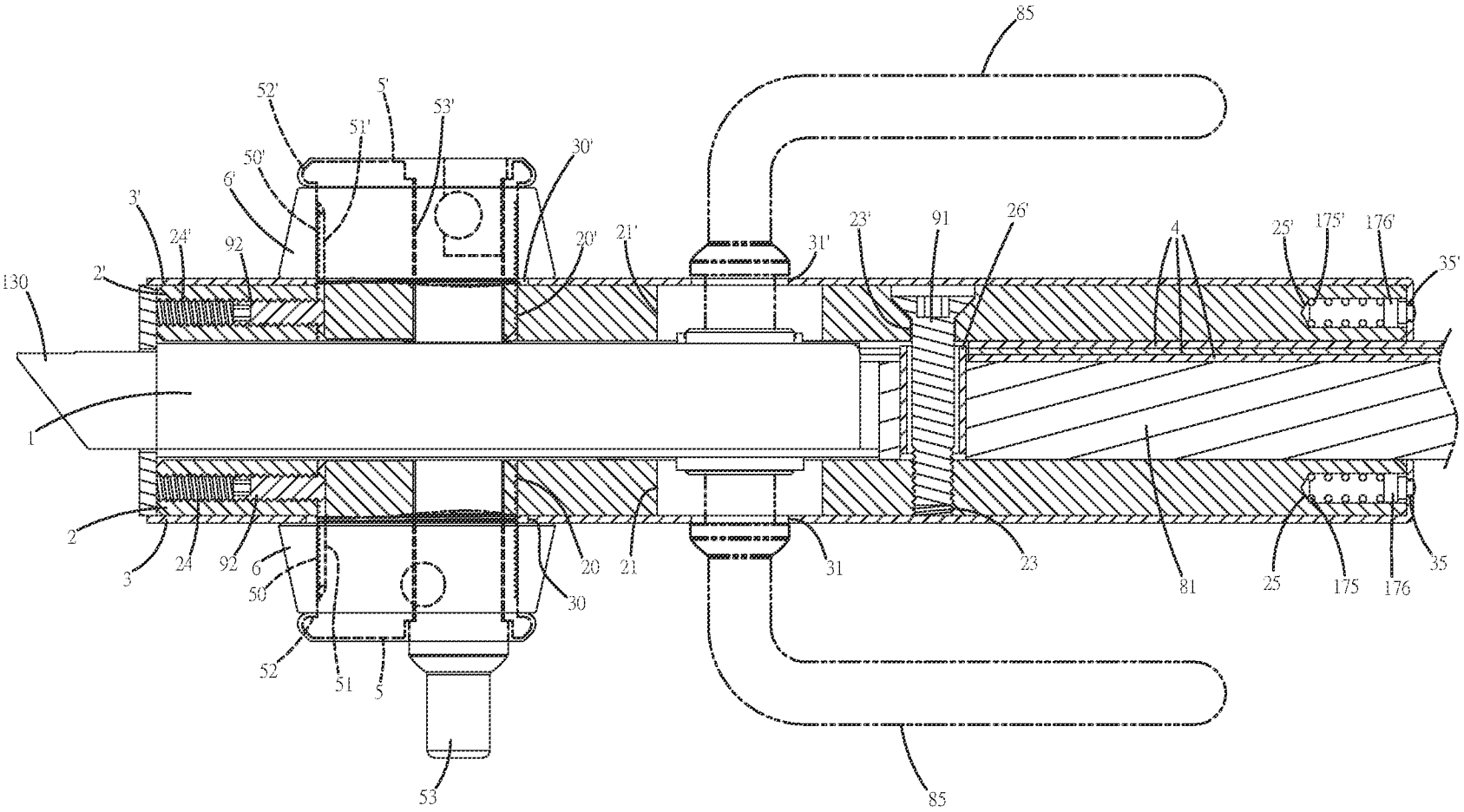
FIG. 3 is an end cross sectional view of the door lock of the present invention.

Referring to FIGS. 1 to 3, the door lock of the present invention comprises a lock 1 having a base 11, a cover 12, a latch unit 13, an expansion spring 170, a link 14, a compression spring 171, a first drive member, 15, a second drive member 16 and a torsion spring 172. The base 11 has a bottom plate 110 with two lateral plates 116. One front plate 117 and one rear plate 118 respectively extend from the four sides of the bottom plate 110. The bottom plate 110 includes a first bore 111 and a second bore 112 defined therethrough. Multiple rods 113 extend from the top face of the bottom plate 110. Each rod 113 has a threaded hole 114 defined in the distal end thereof. Two first slots 115 are respectively defined in the two sides of the bottom plate 110.

The cover 12 includes a through hole 121 through which the rods 113 extend. The cover 12 has a third bore 122 and a fourth bore 123 respectively defined therethrough, wherein the third bore 122 is located corresponding to the first bore 111, and the fourth bore 123 is located corresponding to the second bore 112. The cover 12 further includes two second slots 124 respectively in two sides thereof. The two second slots 124 are located corresponding to the first slots 115. The cover 12 is connected to the base 11 to form a room "A" therebetween. The latch unit 13, the link 14, the first drive member, 15, the second drive member 16, the expansion spring 170, the compression spring 171 and the torsion spring 172 are accommodated within the room "A".

The latch unit 13 includes a latch 130 and an extension portion 131 that is connected to the latch 130. The latch 130 is designed to be inserted into the door frame 80 via a strike plate. The extension portion 131 includes two identical plates which are connected to the top and the bottom of one end of the latch 130 by bolts 90, so that the extension portion 131 is movably accommodated in the base 11. The extension portion 131 includes a positioning portion 132 to which one end of the expansion spring 170 is hooked. A recess 133 is defined in the distal end of the extension portion 131 and a notch 134 is defined in one of two insides of the recess 133. A push ramp 135 is formed adjacent to the notch 134. The extension portion 131 includes a restriction slot 136 with which a protrusion 141 extending from the link 14 is engaged. The expansion portion 131 includes a lug 137 which is located in the restriction slot 136 and separates the restriction slot 136 into two recessed areas which communicate with each other. When the latch unit 13 moves, the protrusion 141 moves from one recesses area to another one of the two recessed areas by guidance of the lug 137.

The link 14 includes a pivotal hole 140 through which one of the rods 113 extends. The protrusion 141 extends from the link 14 and is engaged with the first and second slots 115, 124 and the restriction slot 136. The link 14 includes a guide portion 143 to which the first drive member 15 pushes.

The first drive member 15 includes a restriction hole 150 and a top portion 151. The top portion 151 pushes the guide portion 143 to move the link 14. A bolt 90 extends through the restriction hole 150 of the first drive 15 and is connected to the first and second cylinders 53, 53' so that first drive member 15 is co-rotated with the first and second cylinders 53, 53'.

The second drive member 16 includes a tube 160 which extends through the second bore 112 and the fourth bore 123. Two push portions 161 are formed on the first end of the second drive 16 so as to push the latch unit 13. A key part 162 is formed on the second end of the second drive member 16 so as to shift the torsion spring 172. The tube 160 includes a rectangular hole 163, and a door handle 85 is connected to the rectangular hole 163 so that the second drive member 16 is co-rotated with the door handle 85.

The two legs of the expansion spring 170 are hooked between the rod 113 of the base 11 and the positioning portion 132 of the latch unit 130 so as to provide a recovery force of the latch unit 13.

The two legs of the compression spring 171 are biased between the restriction portion 142 of the link 14 and the lateral plate 116 so as to provide a recovery force of the link 14.

The torsion spring 172 is mounted to the tube 160 and has two legs thereof crossly located two sides of the key part 162 of the second drive member 16 and two sides of the rear plate 118, so as to provide a recovery force of the key part 162.

An inside plate 2 includes a first threaded hole 122 located corresponding to the third bore 122 so as to be connected to the inside lock 5, a first hole 21 located corresponding to the fourth bore 123, and a second hole 22 located corresponding to the through hole 121 so that the bolt 90 extends. The inside plate 2 further has a threaded aperture 23 through which a screw 91 threadedly extends, a first adjustment threaded hole 24 transversely communicating with the first threaded hole 20 so that the countersunk head bolt 92 extends, and a first restriction hole 25 in which a biasing spring 175 and an end piece 176 are received therein.

An outside plate 2' includes a second threaded hole 20' located corresponding to the first bore 111 so as to be connected to the outside lock 5', a third hole 21' located corresponding to the second bore 112, a fourth hole 22' located corresponding to the threaded hole 114 so that the bolt 90 extends, The outside plate 2' further includes a through hole 23' located corresponding to the threaded aperture 23 of the inside plate 2 so that a bush 26' is inserted therein, a second adjustment threaded hole 24' transversely communicating with the second threaded hole 20' so that the countersunk head bolt 92 extends, and a second restriction hole 25' in which the biasing spring 175 and the end piece 176 are received therein.

An inside face plate 3 includes a first aperture 30 located corresponding to the first threaded hole 20 so as to be connected to the inside lock 5, a second aperture 31 located corresponding to the first hole 21 so as to be connected with the door handle 85, a first cutout 34 located corresponding to the first adjustment threaded hole 24, and a first positioning hole 35 with which the end piece 176 is engaged.

An outside face plate 3' includes a third aperture 30' located corresponding to the second threaded hole 20' so as to be connected to the outside lock 5', a fourth aperture 31' located corresponding to the third hole 21' so as to be connected to the door handle 85, a second cutout 34' located corresponding to the second adjustment threaded hole 24', and a second positioning hole 35' with which the end piece 176 is engaged.

A washer plate 4 is clamped between the inside outside plate 2' and the outside face plate 3' so as to fill the gap between the lock 1 and the glass door 81.

An inside lock set 5 includes a first threaded body 50 threadedly connected to the first threaded hole 20 of the inside plate 2. Multiple first axial grooves 51 are defined in the first threaded body 50 so that the countersunk head bolts 92 contact. A first lip 52 extends outward from the top of the first threaded body 50, and a first cylinder 53 is located in the first threaded body 50 so as to be connected to the first drive member 15 and to rotate the first threaded body 50.

An outside lock set 5' includes a second threaded body 50' threadedly connected to the second threaded hole 20' of the outside plate 2'. Multiple second axial grooves 51' are defined in the second threaded body 50' so that the countersunk head bolts 92 contact. A second lip 52' extends outward from the top of the second threaded body 50', and a second cylinder 53' is located in the second threaded body 50' so as to be connected to the first drive member 15 and to rotate the second threaded body 50'.

An inside collar 6 is clamped between the inside face plate 3 and the inside lock set 5. When the first threaded body 50 is connected to the first threaded hole 20, the first axial groove 51 is adjusted to a position in front of the first adjustment threaded hole 24 by the height of the inside collar 6. Therefore, the countersunk head bolts 92 contacts the inside of the first axial groove 51.

An outside collar 6' is clamped between the outside face plate 3' and the outside lock set 5'. When the second threaded body 50' is connected to the second threaded hole 20', the second axial groove 51' is adjusted to a position in front of the second adjustment threaded hole 24' by the height of the outside collar 6'. Therefore, the countersunk head bolts 92 contacts the inside of the second axial groove 51'.

Figure 4:
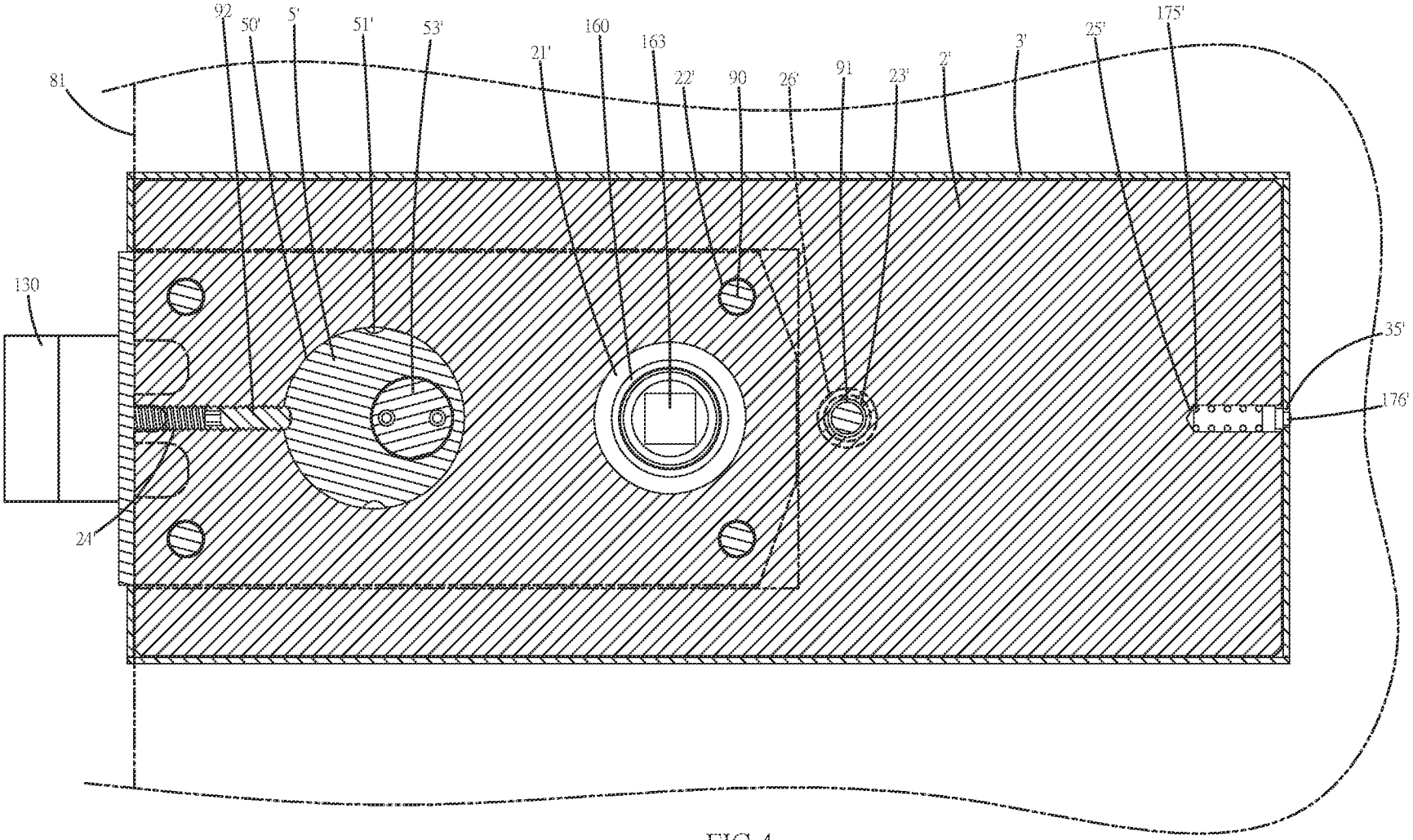
FIG. 4 is planar cross sectional view of the door lock of the present invention.
Figure 5:
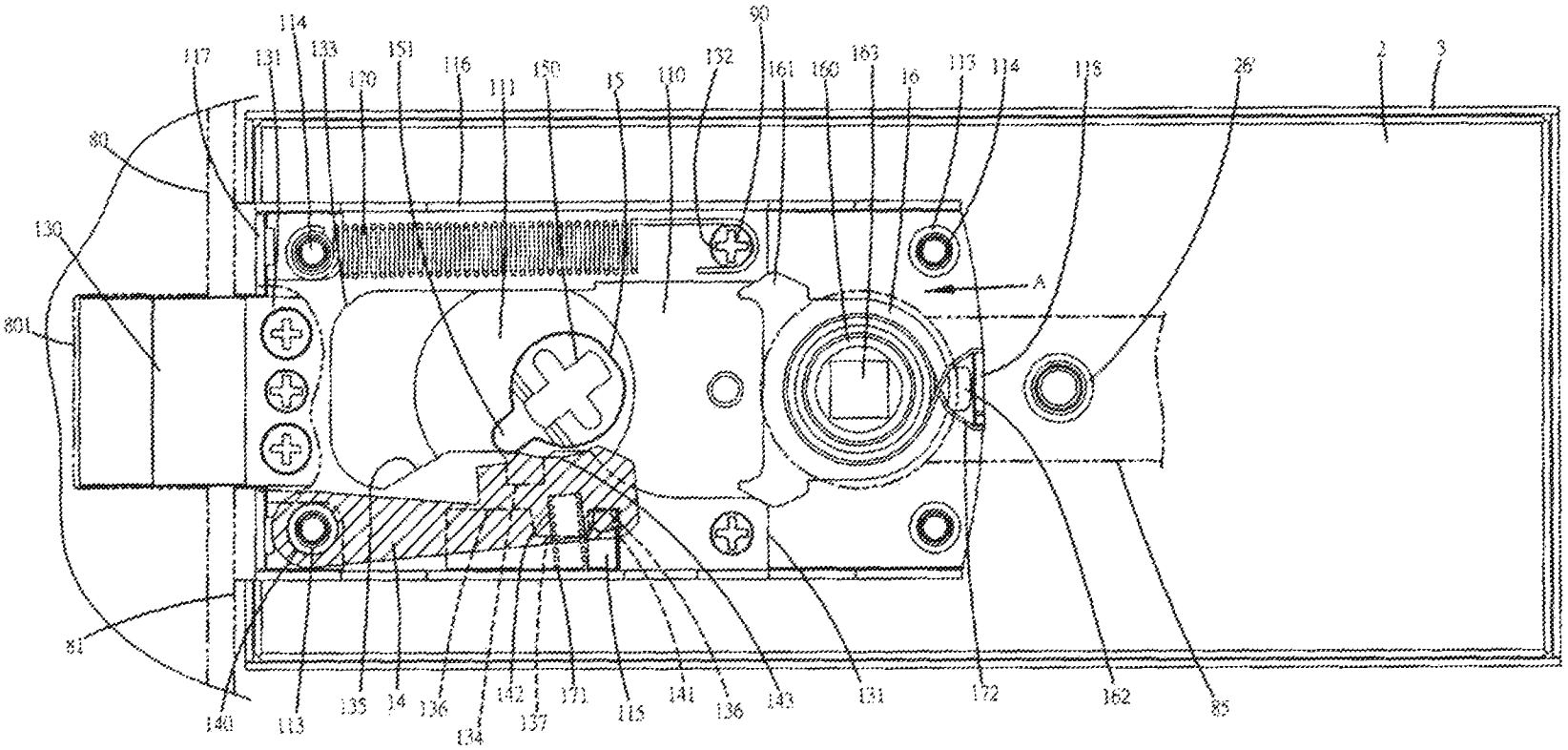
FIG. 5 illustrates that the door lock of the present invention is locked.

When installation the door lock, the screw 91 extends through the through bore 23' and the bush 26', and is threadedly connected to the threaded aperture 23 so that the inside plate 2 and the outside plate 2' are fixed to the two sides of the lock 1 and connected to the glass door 81. When the thickness of the glass door 81 is smaller than the thickness of the lock 1, the washer plate 4 is sandwiched between the outside plate 2' and the outside face plate 3' to fill the thickness difference between the lock 1 and the glass door 81. Therefore, the inside and outside face plates 3, 3' are respectively, connected to the inside and outside plates 2, 2'. The first aperture 30, the third aperture 30' and the second aperture 31 and the fourth aperture 31' are respectively located in alignment with the first and second threaded holes 20, 20' and the first and third holes 21, 21'. The inside collar 6 and the outside collar 6' are respectively located in alignment with the first aperture 30 and the third aperture 30'. The first and second threaded bodies 50, 50' respectively extend through the inside collar 6 and the outside collar 6' and the first aperture 30 and the third aperture 30', and then are threadedly fixed to the first and second threaded holes 20, 20'. The inside collar 6 and the outside collar 6' are clamped between the first and second lips 52, 52' and the inside and outside face plates 3, 3'. The first and second axial grooves 51, 51' are adjusted to be in front of the first and second adjustment threaded holes 24, 24'. The countersunk head bolt 92 are rotated to contact against the respective insides of the first and second axial grooves 51, 51' as shown in FIGS. 3, 4, to prevent the inside lock 5 and the outside lock 5' from being pulled out from the inside plate 2 and the outside plate 2'. The first drive member 15 is located in the recess 133 and is located laterally to the guide portion 143 as shown in FIG. 5. The first drive member 15 controls movement of the latch unit 13 to adjust the latch 130 to be retracted and separated from door frame 80.

Figure 6:
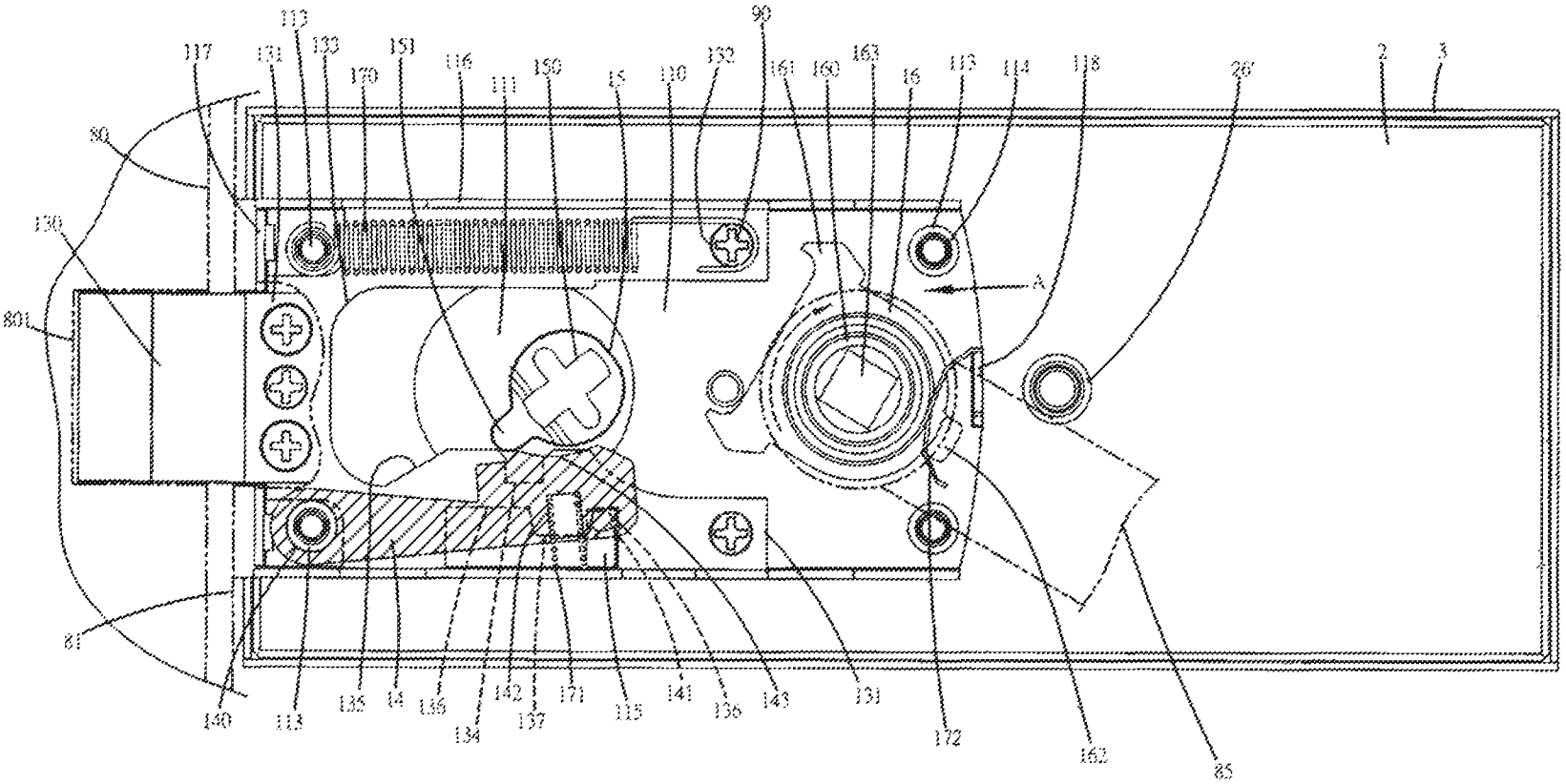
FIG. 6 illustrates that the door handle of the door lock of the present invention in FIG. 5 is rotated.

When the glass door 81 is locked, and the door handle 85 is rotated downward, the second drive member 16 is rotated about the tube 160 so that the push portion 161 is rotated upward and key part 162 pushes one end of the torsion spring 172 to move away from the rear plate 118. At this moment, the positioning portion 132 is not moved within a rotational radius of the push portion 161, so that the rotation of the door handle 85 cannot move the latch unit 15 to the right, so that the glass door 81 cannot be opened by rotating the door handle 85 as shown in FIG. 6.

Figure 7:
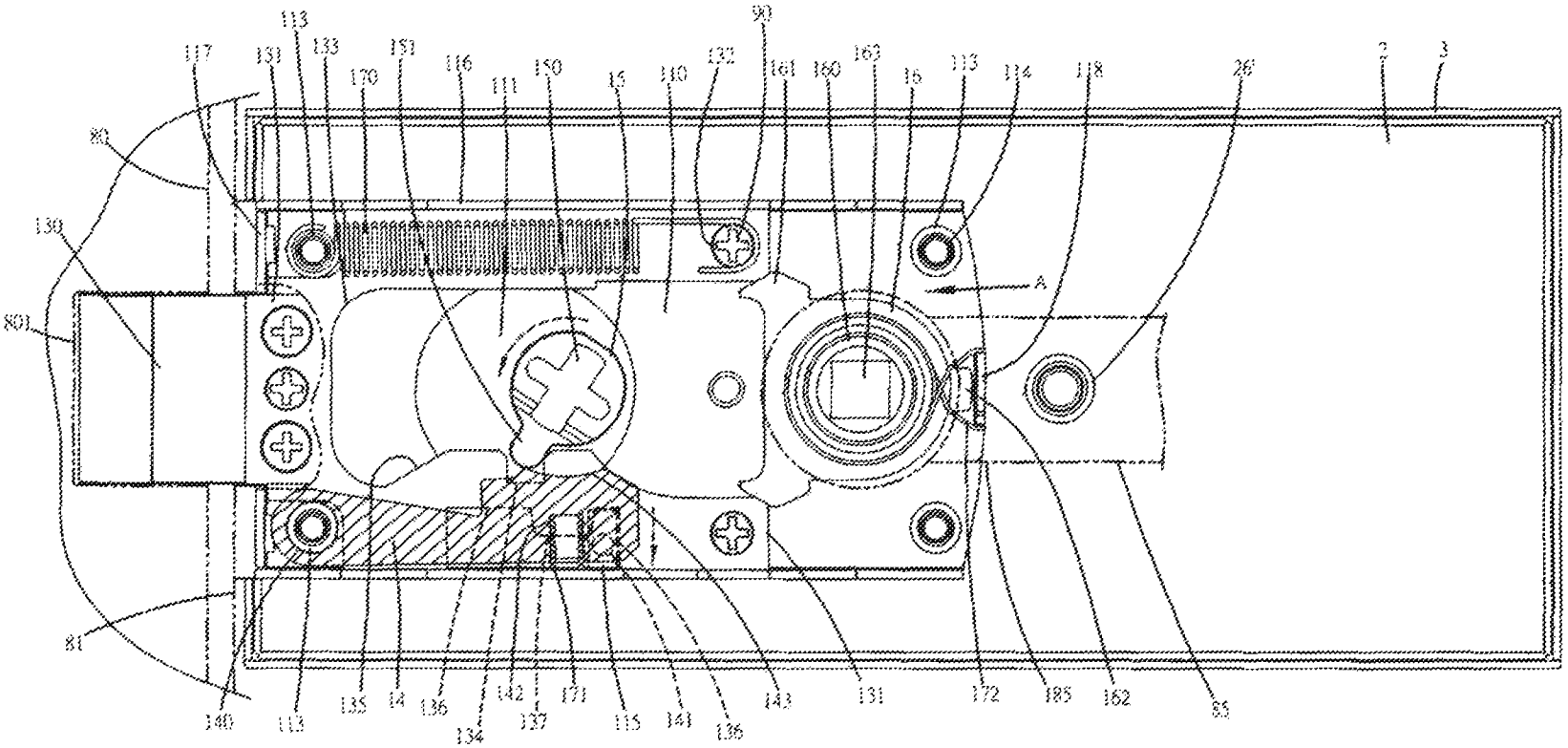
FIG. 7 is a cross sectional view to show that the first drive member in FIG. 5 is rotated.
Figure 8:
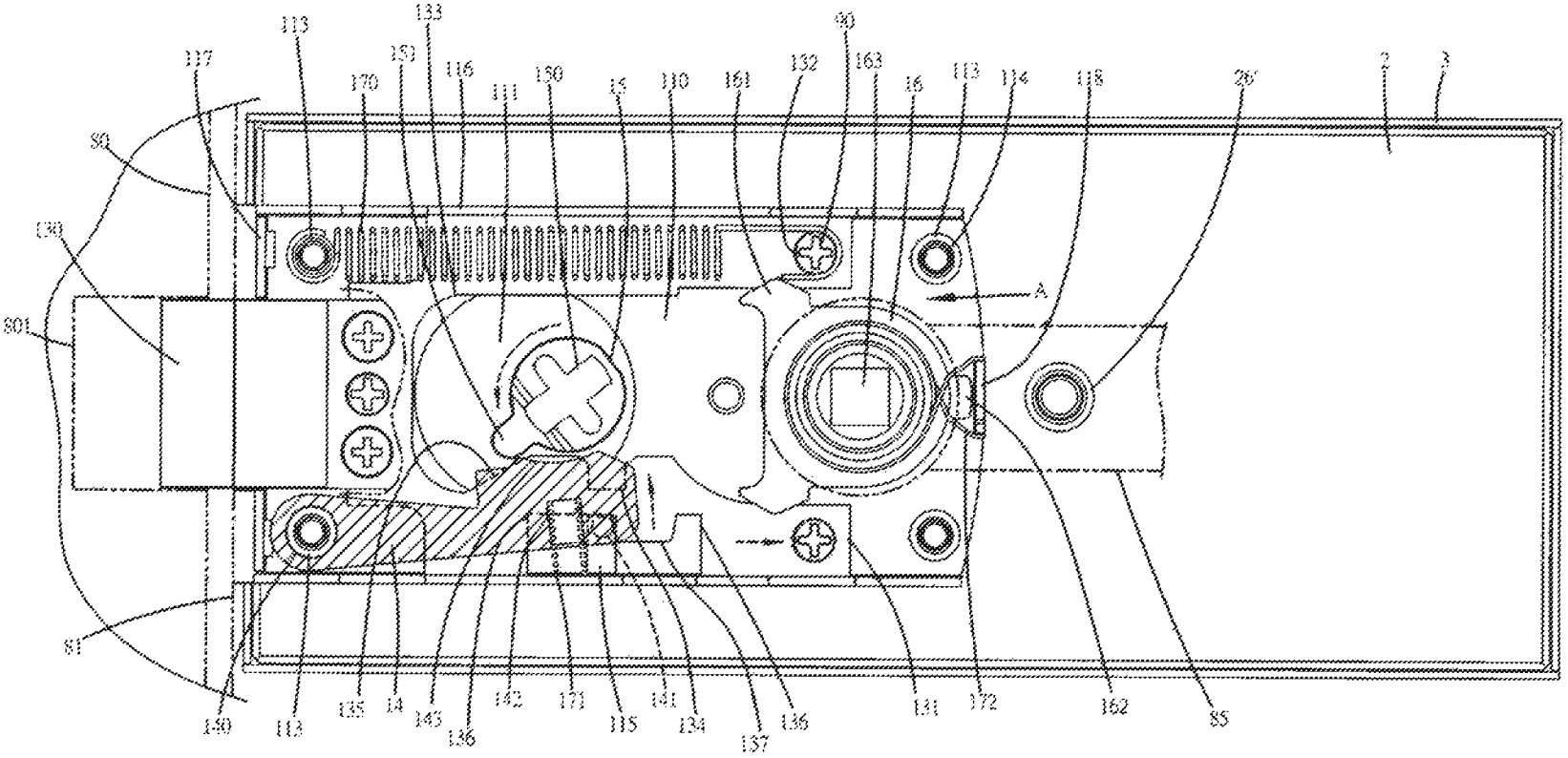
FIG. 8 is a cross sectional view to show that the glass door is temporarily closed when the first drive member in FIG. 5 is rotated one revolution.

When the first cylinder 53 is rotated to drive the first drive member 15 to rotate one revolution counter clockwise, the top portion 151 pushes the guide portion 143 so that the link 14 rotates clockwise, wherein the protrusion 141 is moved along the first and second slots 115, 124, and the compression spring 171 is compressed. The protrusion 141 moves to the highest horizontal position where is close or lower than the horizontal position of the lug 137, and the top portion 151 is engaged with the notch 134 as shown in FIG. 7. When the first drive member 15 continuously rotated, the top portion 151 engaged with the notch 134 moves the whole latch unit 13 to move to the right. The protrusion 141 is removed from the right side recessed area of the restriction slot 136 to the left side recessed area of the restriction slot 136, and the link 14 is moved upward counter clockwise by the recovery force from the compression spring 71, so that the guide portion 143 moves the top portion 151 upward to be located above the notch 134. In other words, as shown in FIG. 8, the protrusion 141 is located in the left side recessed area of the restriction slot 136. The positioning portion 132 moves to right and enters the rotational radius of the push portion 161 of the second drive member 16. Therefore, the first cylinder 53 is rotated on revolution and cannot completely separate the latch 130 of the latch unit 13 from the door frame 80. A portion of the latch 130 is located in the positioning slot 801, and the glass door 81 is temporarily closed.

Figure 10:
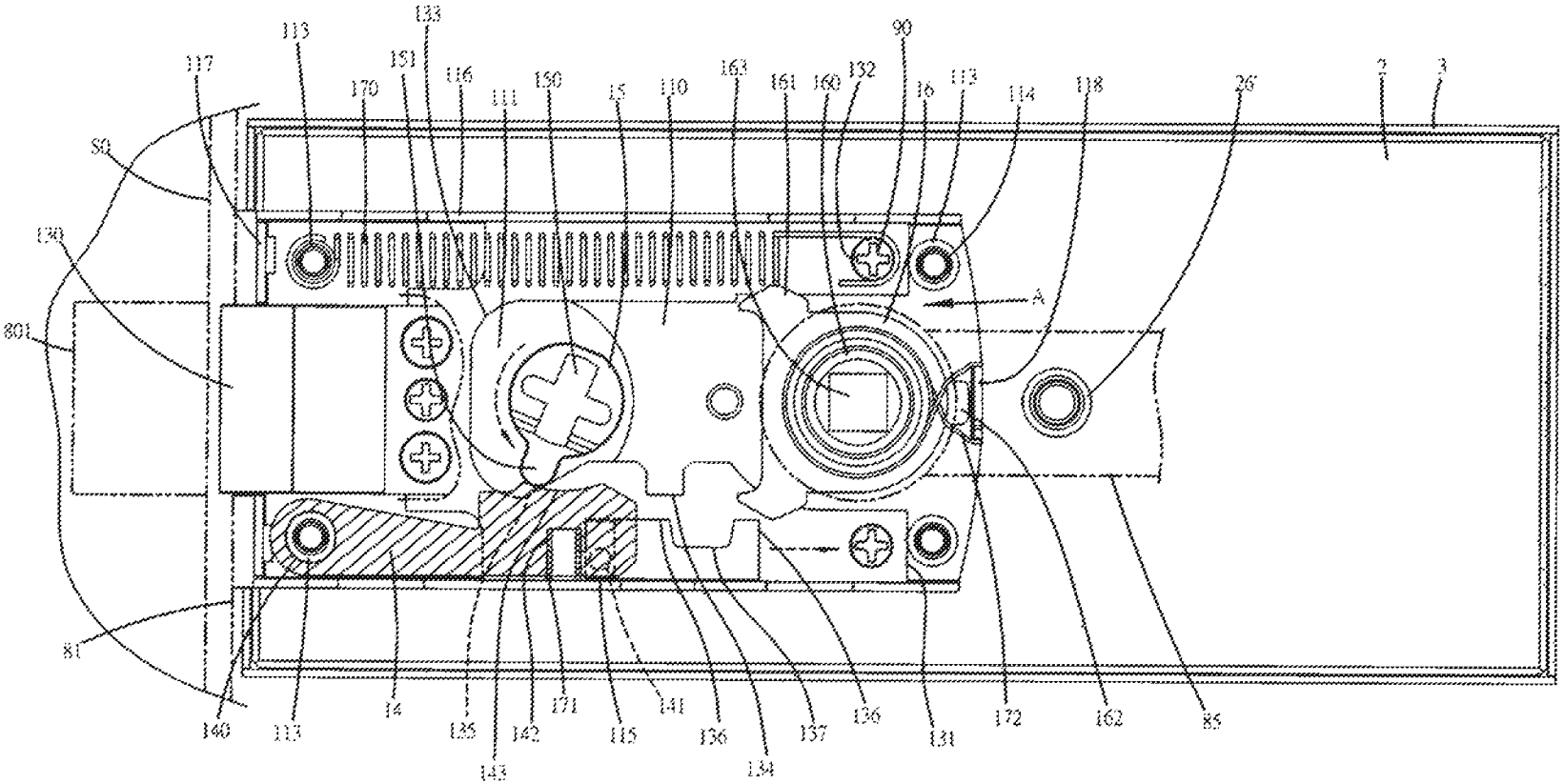
FIG. 10 is a cross sectional view to show that the glass door is opened by further rotating the first cylinder in FIG. 8 one more revolution.

When a user wants to open the glass door 81 that is temporarily closed, the first way is to continuously rotate the first cylinder 15 by one hand to let the top portion 151 co-rotate with the first cylinder 53. The top portion 151 pushes the push ramp 135 toward the right until the latch 130 is completely separated from the positioning slot 801 as shown in FIG. 10. The glass door 81 is able to be opened by rotating the first cylinder 53 to consecutive revolutions.

Figure 9:
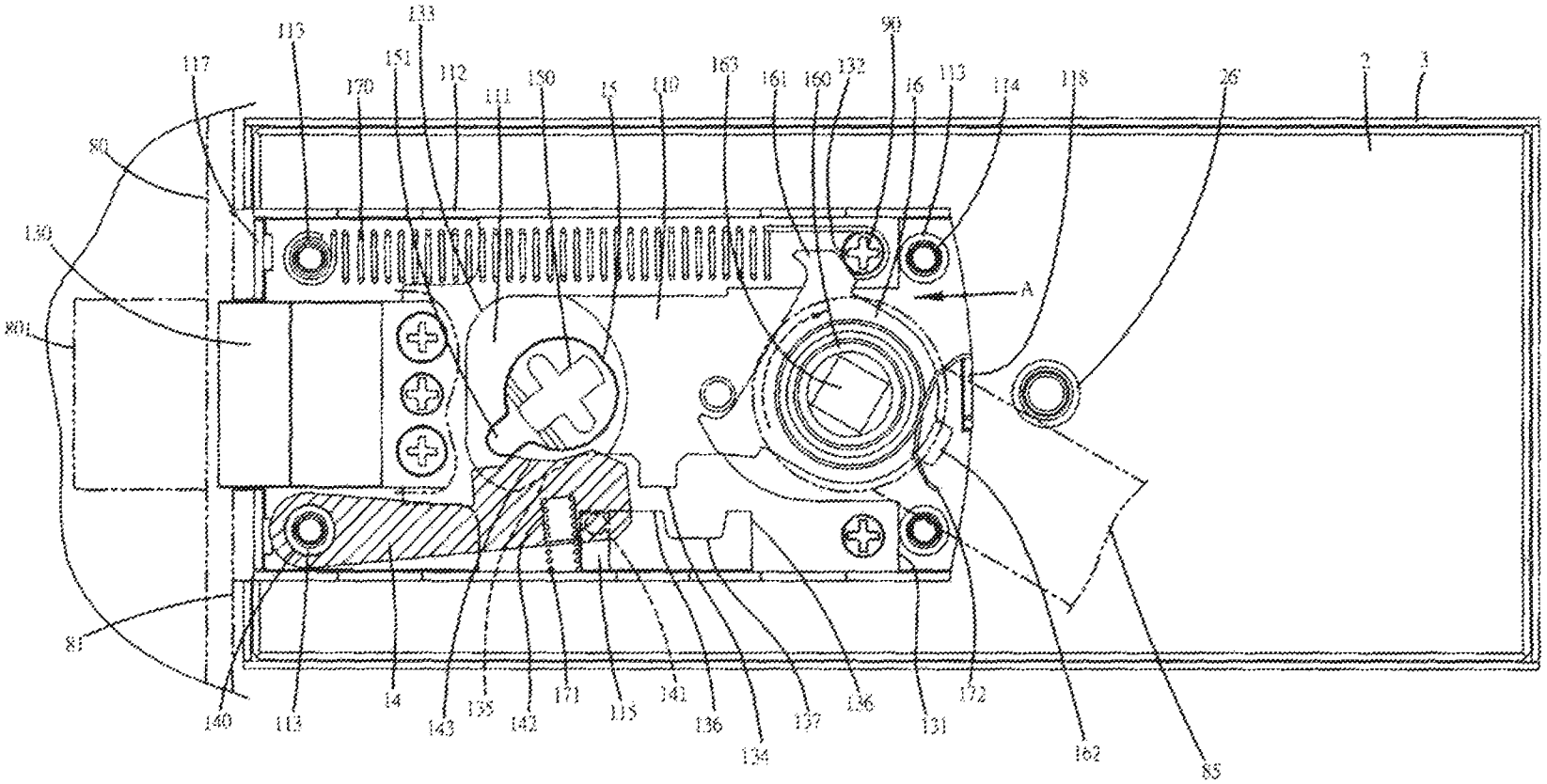
FIG. 9 is a cross sectional view to show that the door handle in FIG. 8 is rotated one revolution to open the glass door.

The second way to open the glass door 81 is to rotate the door handle 85 downward and clockwise, the door handle 85 drives the push portion 161 of the second drive member 16 to rotate in the same direction, so that the push portion 161 further pushes the positioning portion 132 toward the right, until the latch 130 is completely separated from the positioning slot 801 as shown in FIG. 9. The glass door 81 is able to be opened by rotating the door handle 85.

While we have shown and described the embodiment in accordance with the present invention, it should be clear to those skilled in the art that further embodiments may be made without departing from the scope of the present invention.

What is claimed is:

1. A door lock comprising:

a lock (1) having a base (11), a cover (12), a latch unit (13), an expansion spring (170), a link (14), a compression spring (171), a first drive member (15), a second drive member (16) and a torsion spring (172);

the base (11) having a bottom plate (110) with two lateral plates (116), one front plate (117) and one rear plate (118) respectively extending from four sides of the bottom plate (110), the bottom plate (110) including a first bore (111) and a second bore (112) defined therethrough, multiple rods (113) extending from a top face of the bottom plate (110), each rod (113) having a threaded hole (114) defined in a distal end thereof, two first slots (115) respectively defined in two sides of the bottom plate (110);

the cover (12) including a plurality of through holes (121) through which the rods (113) extend, the cover (12) having a third bore (122) and a fourth bore (123) respectively defined therethrough, the third bore (122) located corresponding to the first bore (111), the fourth bore (123) located corresponding to the second bore (112), the cover (12) including two second slots (124) respectively in two sides thereof, the two second slots (124) located corresponding to the first slots (115), the cover (12) being connected to the base (11) to form a room (A) therebetween, the latch unit (13), the link (14), the first drive member (15), the second drive member (16), the expansion spring (170), the compression spring (171) and the torsion spring (172) being accommodated within the room (A);

the latch unit (13) including a latch (130) and an extension portion (131) that is connected to the latch (130), the extension portion (131) including a positioning portion (132) to which one end of the expansion spring (170) is hooked, a recess (133) defined in a distal end of the extension portion (131) and a notch (134) defined in one of two insides of the recess (133), a push ramp (135) formed adjacent to the notch (134), the extension portion (131) including a restriction slot (136) with which a protrusion (141) extending from the link (14) is engaged, the expansion portion (131) including a lug (137) which is located in the restriction slot (136) and separates the restriction slot (136) into two recessed areas which communicate with each other, when the latch unit (13) moves, the protrusion (141) moves from one recessed area to another one of the two recessed areas by guidance of the lug (137);

the link (14) including a pivotal hole (140) through which one of the rods (113) extends, the protrusion (141) extending from the link (14) and engaged with one of either the first slot (115) or the second slot (124) and the restriction slot (136), the link (14) including a guide portion (143) to which the first drive member (15) pushes;

the first drive member (15) including a restriction hole (150) and a top portion (151), the top portion (151) pushing the guide portion (143) to move the link (14), a bolt (90) extending through the restriction hole (150) of the first drive member (15) and connected to a first cylinder (53) and a second cylinder (53') so that first drive member (15) is co-rotated with the first and second cylinders (53, 53');

the second drive member (16) including a tube (160) which extends through the second bore (112) and the fourth bore (123), two push portions (161) formed on a first end of the second drive member (16) so as to push the latch unit (13), a key part (162) formed on a second end of the second drive member (16) so as to shift the torsion spring (172), the tube (160) including a rectangular hole (163), a door handle (85) connected to the rectangular hole (163) so that the second drive member (16) is co-rotated with the door handle (85);

the expansion spring (170) hooked between the rod (113) of the base (11) and the positioning portion (132) of the latch unit (130);

the compression spring (171) biased between the restriction portion (142) of the link (14) and the lateral plate (116);

the torsion spring (172) mounted to the tube (160) and having two legs which are crossly located two sides of the key part (162) of the second drive member (16) and two sides of the rear plate (118);

an inside plate (2) including a first threaded hole (20) located corresponding to the third bore (122), a first hole (21) located corresponding to the fourth bore (123), a second hole (22) located corresponding to the through hole (121), a threaded aperture (23) through which a screw (91) threadedly extends, a first adjustment threaded hole (24) communicating with the first threaded hole (20), and a first restriction hole (25) in which a first biasing spring (175) and a first end piece (176) are received therein;

an outside plate (2') including a second threaded hole (20') located corresponding to the first bore (110, a third hole (21') located corresponding to the second bore (112), a fourth hole (22') located corresponding to threaded hole (114), a through bore (23') located corresponding to the threaded aperture (23) of the inside plate (2), a second adjustment threaded hole (24') communicating with the second threaded hole (20'), and a second restriction hole (25') in which a second biasing spring (175') and a second end piece (176') are received therein;

an inside face plate (3) including a first aperture (30) located corresponding to the first threaded hole (20), a second aperture (31) located corresponding to the first hole (21), a first cutout (34) located corresponding to the first adjustment threaded hole (24), and a first positioning hole (35) with which the first end piece (176) is engaged;

an outside face plate (3') including a third aperture (30') located corresponding to the second threaded hole (20'), a fourth aperture (31') located corresponding to the third hole (21'), a second cutout (34') located corresponding to the second adjustment threaded hole (24'), and a second positioning hole (35') with which the second end piece (176') is engaged;

a washer plate (4) clamped between the inside outside plate (2') and the outside face plate (3');

an inside lock set (5) including a first threaded body (50) threadedly connected to the first threaded hole (20) of the inside plate (2), multiple first axial grooves (51) defined in the first threaded body (50), a first lip (52) extending outward from a top of the first threaded body (50), and a first cylinder (53) located in the first threaded body (50) so as to rotate the first threaded body (50);

an outside lock set (5') including a second threaded body (50') threadedly connected to the second threaded hole (20') of the outside plate (2'), multiple second axial grooves (51') defined in the second threaded body (50'), a second lip (52') extending outward from a top of the second threaded body (50'), and a second cylinder (53') located in the second threaded body (50') so as to rotate the second threaded body (50');

an inside collar (6) clamped between the inside face plate (3) and the inside lock set (5);

an outside collar (6') clamped between the outside face plate (3') and the outside lock set (5');

wherein the first and second axial grooves (51, 51') are located in front of the first and second adjustment threaded holes (24, 24') so that two screw rods (92) respectively contact against an inside of the first and second axial grooves (51, 5l'), the first drive member (15) controls movement of the latch unit (13) to adjust the latch (130) to be retracted and separated from door frame (80).

2. The door lock as claimed in claim 1, wherein the link (14) has a restriction portion (142) and one end of the compression spring (171) is positioned therein.

3. The door lock as claimed in claim 2, wherein the extension portion (131) and the latch (130) are formed as one piece.

4. The door lock as claimed in claim 1, wherein the extension portion (131) is connected to one end of the latch (130) by bolts (90).

5. The door lock as claimed in claim 4, wherein the extension portion (131) is a single plate.

6. The door lock as claimed in claim 4, wherein the extension portion (131) includes two identical plates which are connected to a top and a bottom of one end of the latch (130) by bolts (90).

* * * * *